United States Patent [19]

Stakes

[11] Patent Number: 4,787,478

[45] Date of Patent: Nov. 29, 1988

[54] ROOF LADDER ATTACHMENT

[76] Inventor: John W. Stakes, Jr., 1640 Chanticleer Ave., Santa Cruz, Calif. 95062

[21] Appl. No.: 18,031

[22] Filed: Feb. 25, 1987

[51] Int. Cl.[4] ..... E06C 7/48

[52] U.S. Cl. ..... 182/206; 182/107; 182/214

[58] Field of Search ..... 182/214, 206, 107; 248/210

[56] References Cited

U.S. PATENT DOCUMENTS

| | | | |
|---|---|---|---|
| 1,004,284 | 9/1911 | Lehmann | 182/214 |
| 1,007,347 | 10/1911 | Flightner | 182/214 |
| 2,341,510 | 2/1944 | Born | 182/206 |
| 2,934,163 | 4/1960 | Ladewski | 182/214 |
| 4,179,011 | 12/1979 | Morawski | 182/206 |
| 4,311,207 | 1/1982 | Lurry | 182/107 |
| 4,458,783 | 7/1984 | Stakes | 182/206 |

FOREIGN PATENT DOCUMENTS

| | | | |
|---|---|---|---|
| 1260476 | 1/1972 | United Kingdom | 182/214 |

*Primary Examiner*—Machado Reinaldo P.

[57] ABSTRACT

A ladder attachment consisting of 2 pair of bars with holes, connecting rods, locknuts and washers to an extension ladder it forms a frame on the outsides of the ladder that can be adjustably extended over the ridge of a roof.

The attachment allows the ladder to conform to the roof's pitch and be secured to the roof's ridge, or to stabilize the ladder against a wall or over the eve of the roof avoiding damage to the gutters.

1 Claim, 4 Drawing Sheets

ROOF LADDER ATTACHMENT

BACKGROUND OF THE INVENTION

There is a need for a simplified adjustable ladder attachment for trades people including chimney sweeps, roofers, painters, firemen, antenna installers, and homeowners. This present invention is designed to fill this need.

This attachment consists of four pieces (with holes for adjustment to various roof pitches), lock washers, and wing nuts. When assembled and attached to the sides of an extension ladder, it forms an adjustable attachment which is placed over the ridge of a roof to secure the ladder to the roof and allow the ladder to confirm to the pitch of the roof.

Although a number of devices have been used, including U.S. Pat. Nos. 4,311,207, 2,934,163, 4,179,011, and 2,341,510, the advantages of this invention are that it has fewer parts, allowing it to be very mobile, and it is easily and inexpensively manufactured and stored. Its well balanced construction provides stability. Its design allows freedom from obstruction of the working side of the ladder, permitting full use of the entire ladder surface. It is adjustable to a roof's pitch. It is easily assembled, disassembled, and its simplicity of parts allows compact storage.

BRIEF DESCRIPTION OF DRAWINGS

1.

DETAILED DESCRIPTION OF THE INVENTION

Figure 1:
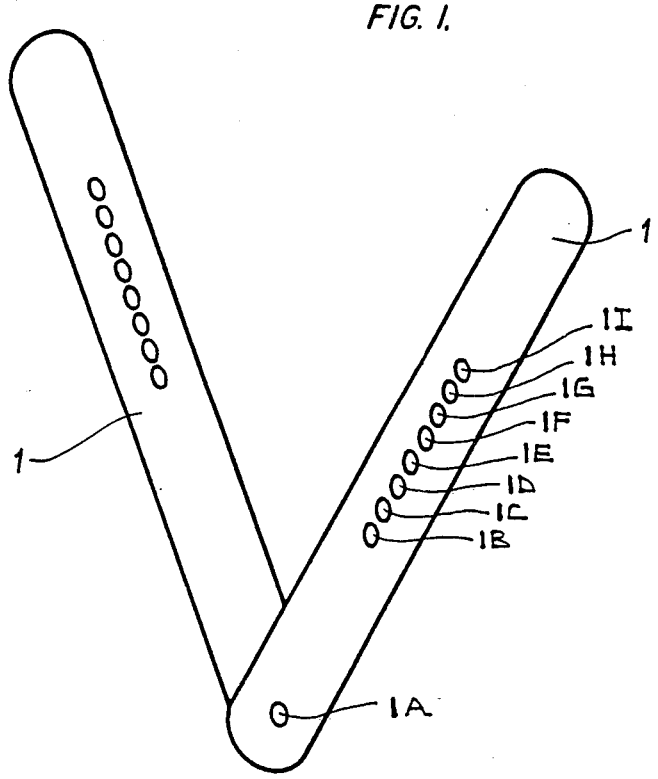
FIG. 1 is a side view of one pair of bars;
2.
Figure 2:
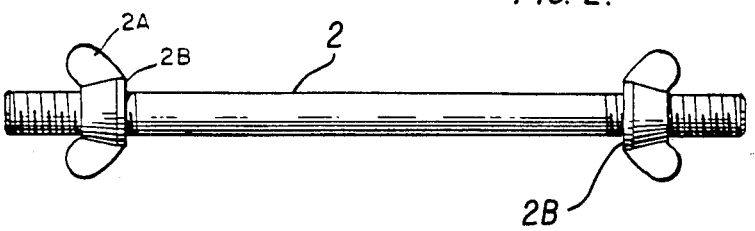
FIG. 2 is a view connecting rod with lock washers and wing nuts;
3.

This adjustable ladder attachment consists of two pairs of bars (FIG. 1), two threaded rods (FIG. 2), Lockwasher (FIG. 2-B), and wing nuts (FIG. 2-A), which when assembled form a frame.

Each bar has nine holes. Holes (1-A) on two bars are connected with one bolt, one lockwasher, and one nut to form one side of frame. The same connecting method is applied to form second side of frame. Holes 1-B through 1-I are used to adjust and secure frame to ladder. Using one rod, (FIG. 2) insert through desired hole 1-B through 1-I, through tubular rung 3-A and through second frame. Then secure bar to the rod with one lockwasher (2-B) and one wing nut (2-A) on each end.

Figure 3:
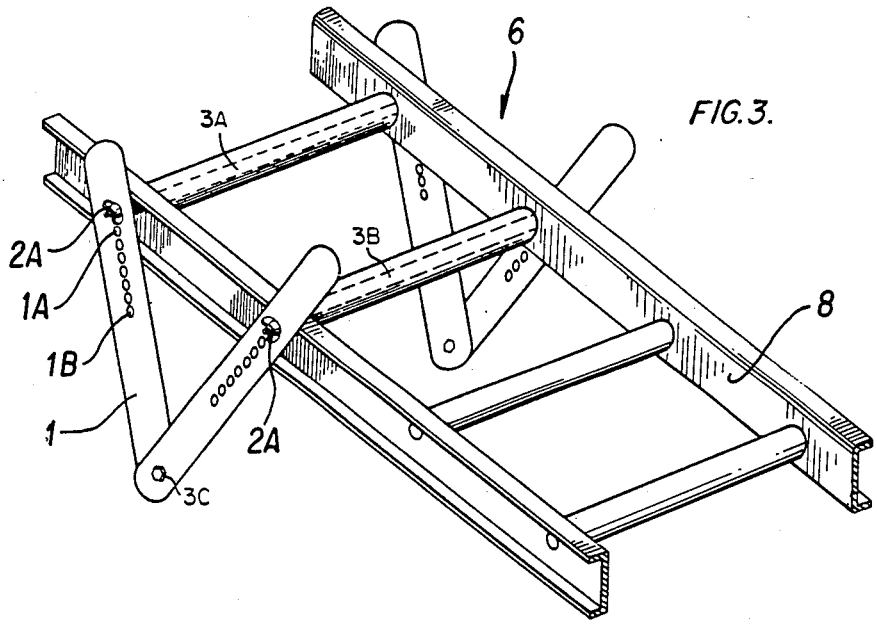
FIG. 3 is a perspective view of frames attached to ladder;
4.
Figure 4:
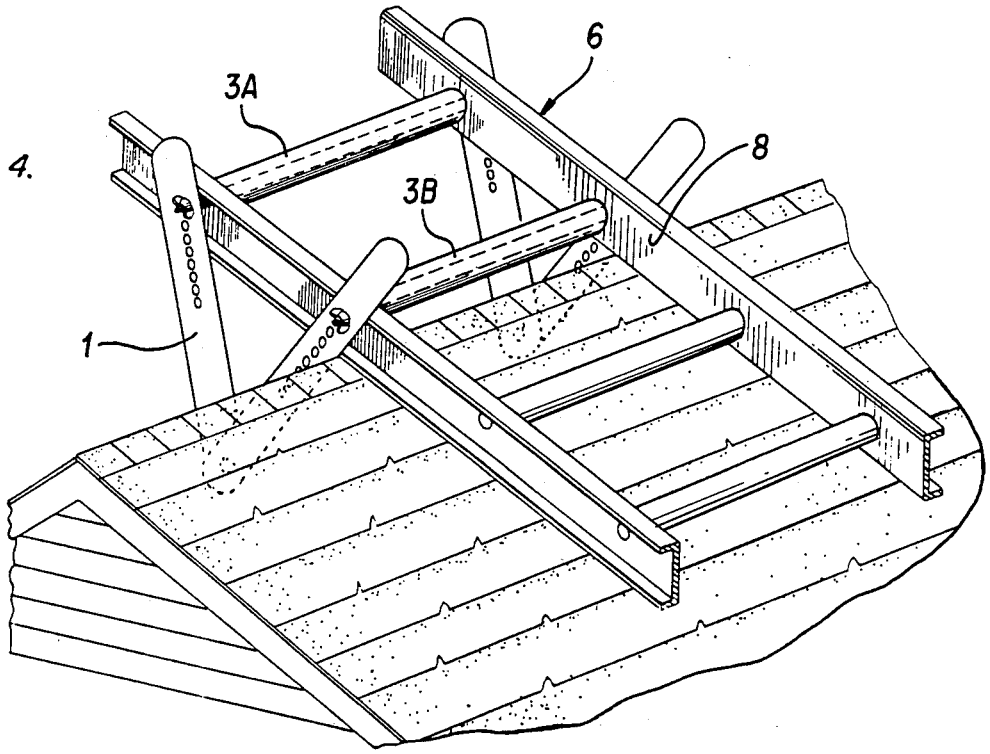
FIG. 4 is an elevational view of the attachment and ladder mounted on the roof.
5.

Use the second rod (FIG. 2); insert through desired hole in bar (1-B through 1-I) to confirm to pitch of the roof, through the tubular rung 3-B, through the matching hole of the second half of frame and secure at each end with one lock washer (2-B) and one wing nut (2-A). FIG. 3-C is connecting bolt and nut used to connect one pair of bars together making one side of frame.

Figure 5:
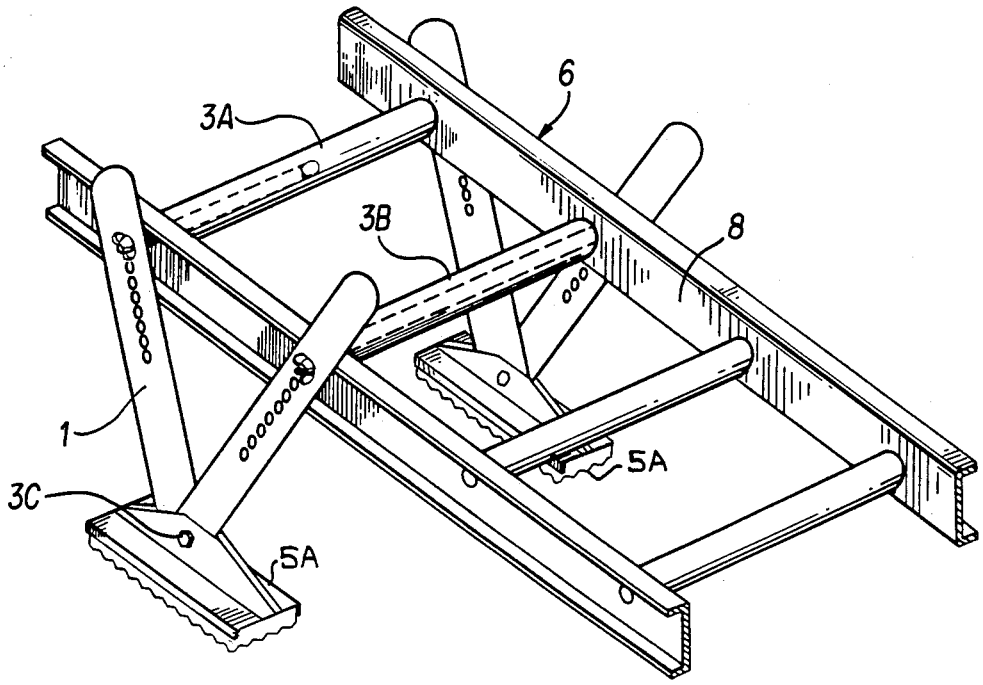
FIG. 5 shows optional feet (5-A) attached to bracket.
Figure 6:
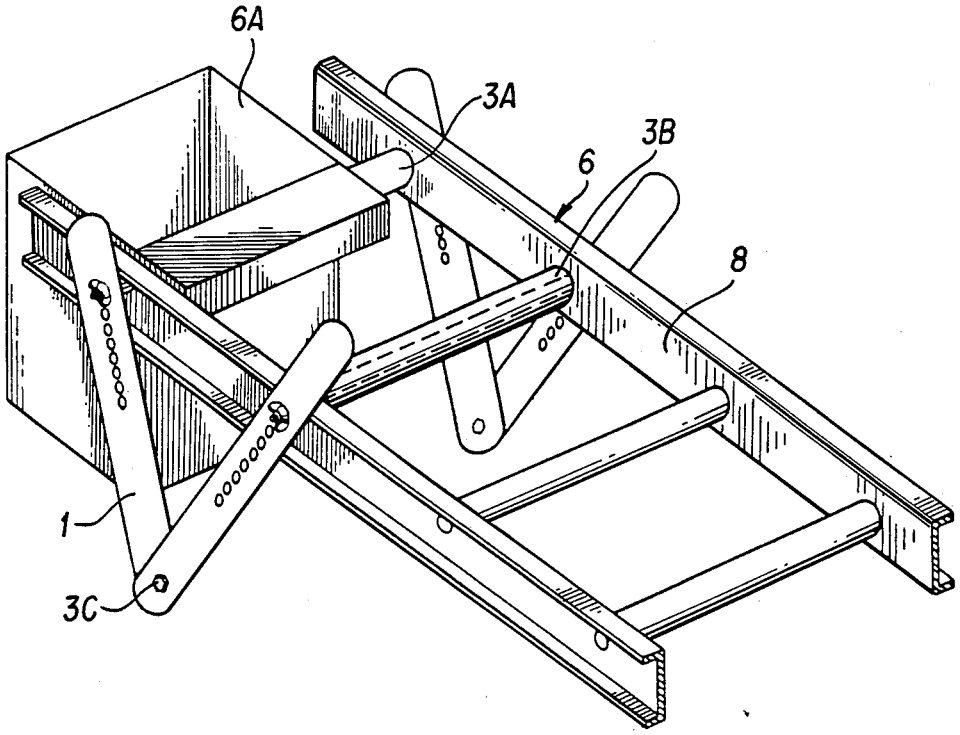

FIG. 5 shows Feet (5-A) attached with same bolt, lockwasher, and nut 3-C used in 1-A.

The assembling of this attachment forms an adjustable frame which secures the ladder to the ridges of the roof and allows the ladder to conform to the pitch of the roof. It is possible to vary the size or shape of the bars or to vary the positions or amount of holes and still be true to the basic concept of this invention and the following claim.

I claim:

1. A ladder attachment for a ladder having side rails and hollow tubular rungs, said attachment comprising:

a pair of separate brackets, each bracket comprising a foot member, a pair of elongated bars, each bar pivotally connected at one end to each other and to said foot member, said bars each having a plurality of holes spaced apart along their longitudinal axis, a pair of bolts longer than the width of said ladder whereby when in operative position each bracket is located adjacent said side rails with some of the holes in each bar in alignment with a pair of said hollow-rungs and interconnected by means of said bolts passing through said hollow rungs and said holes in said bars, and means attached at each end of said bolts for fastening the brackets firmly to the ladder.

* * * * *